US006378451B1

(12) United States Patent
Wetch et al.

(10) Patent No.: US 6,378,451 B1
(45) Date of Patent: Apr. 30, 2002

(54) SIMPLIFIED BALLAST SYSTEM FOR TENSION LEG PLATFORMS

(75) Inventors: Stephen B. Wetch, Sugar Land; Andrew Hunter, Houston, both of TX (US)

(73) Assignee: Union Oil Company California, El Segundo, CA (US)

( * ) Notice: Subject to any disclaimer, the term of this patent is extended or adjusted under 35 U.S.C. 154(b) by 0 days.

(21) Appl. No.: 09/746,353

(22) Filed: Dec. 21, 2000

(51) Int. Cl.[7] ..... B63B 35/44
(52) U.S. Cl. ..... 114/265; 114/125
(58) Field of Search ..... 114/293, 265, 114/125; 405/196, 203, 204, 207, 209

(56) References Cited

U.S. PATENT DOCUMENTS 4,695,201 A * 9/1987 Beskow et al. ..... 114/296
4,864,958 A * 9/1989 Belinsky ..... 114/125
5,147,148 A 9/1992 White et al. ..... 405/199

* cited by examiner

*Primary Examiner*—Jesus D. Sotelo
(74) *Attorney, Agent, or Firm*—Yale S. Finkle; Gregory F. Wirzbicki

(57) ABSTRACT

A simplified ballast system designed for a tension leg platform from which drilling and/or production activities are to be performed in a body of water provides for rapid deballasting via large capacity dump valve(s) and for ballasting for trim operations by use of an eductor at the bottom of a drain well fluidly connected by drain lines to ballast compartments.

44 Claims, 3 Drawing Sheets

SIMPLIFIED BALLAST SYSTEM FOR TENSION LEG PLATFORMS

This invention relates to offshore platforms, and specifically to buoyant platforms, such as a tension leg platform (TLP), used to drill into, and/or produce hydrocarbons from, resource formations under a large body of water, such as an ocean, sea, or lake.

TLPs are generally used in offshore locations where the water depth (usually about 1000–1200 feet or higher) precludes the use of rigid structures extending from above the mean water level to the underwater floor foundation. A typical TLP is composed of a hull structure comprised of a horizontal pontoon base and vertical columns, with the hull structure being capable of providing buoyancy to one or more work platforms for drilling or producing activities, the platform(s) being supported in an upper portion of the hull. The hull is generally divided into several ballast compartments, and pumps are provided for removing or adding water thereto.

The TLP is anchored by tendons to pilings in the underwater floor. The TLP is held stationary by tension constraint, i.e., the TLP is deballasted so as to induce constant, vertical buoyant forces on the hull, which are opposed (or constrained) by tension forces in the anchored tendons. Each tendon is considered a "leg" holding the hull in place, and hence the name: tension leg platform.

A tension leg platform is generally installed by floating the platform-hull structure in a ballast condition to the desired location where the tendons have already been anchored to the seafloor, with the other end freely floating through the aid of detachable buoys or buoyant cans. After the tendons are appropriately attached to the hull, usually by guidelines leading to the production deck or other work platform, the buoys are detached, and the platform-hull structure is rapidly deballasted to float higher in the water and induce the constraining tension forces in the tendons.

Rapid deballasting is crucial during installation to minimize the amount of time that the natural period (or frequency) of the surrounding water equals the natural period of the hull structure. More specifically, in the initial ballast condition, the hull structure has a natural period greater than the natural period of the surrounding water (or wave natural period); conversely, in the final "tensioned" position, the hull structure has a natural period less than the wave natural period. Thus, during the deballasting operation, the hull structure will necessarily pass through a time when its natural period and that of the surrounding water are the same. This sets up a potentially unsafe condition, in which the integrity of the entire hull structure is in danger. For this reason, rapid deballasting is essential, so as to minimize time exposure to an unsafe condition.

To provide for rapid deballasting, TLPs have been equipped with one or more pump rooms containing large capacity pumps to draw down the water in the ballast compartments. While this method serves the intended purpose, after the rapid deballasting to install the TLP, the pumps never again need to operate at full capacity, since only ballast trimming operations (to adjust for weight added to, or removed from, the TLP) are needed thereafter. It clearly would be desirable if a rapid deballast system could be provided without the need for one or more large capacity pumps.

SUMMARY OF THE INVENTION

The present invention provides a TLP having a simplified ballast system.

The TLP is greatly simplified in providing a simple eductor in one or more drain wells within the hull column(s) to handle ballast trimming operations while rapid deballasting is accomplished via one or more large diameter dump valves on one or more of the upper column ballast compartments. As a result, pump room(s) with all associated equipment, e.g., power outlets & cables, lighting, and sea chests are eliminated.

DETAILED DESCRIPTION OF THE INVENTION

This invention provides a simplified, ballast system for a TLP. Two features, in particular, are simplified, namely, (1) the pumping system for trim ballast operations and (2) the rapid deballast system, as will now be discussed in detail.

The Drain Well-Eductor System

Figure 1:
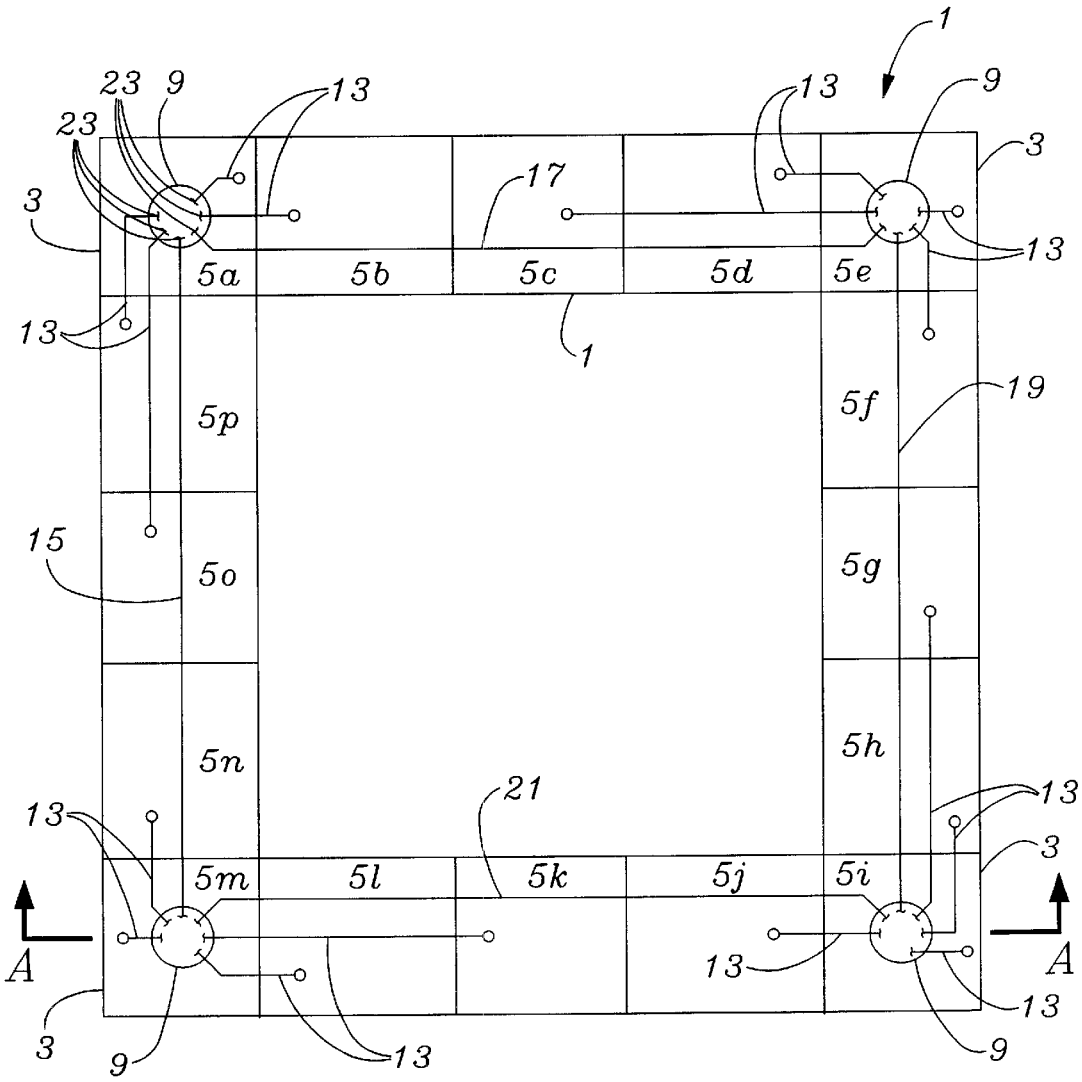
FIG. 1 is a plan view of the pontoon of the hull structure of a TLP incorporating the drain-well eductor system of the invention.
Figure 2:
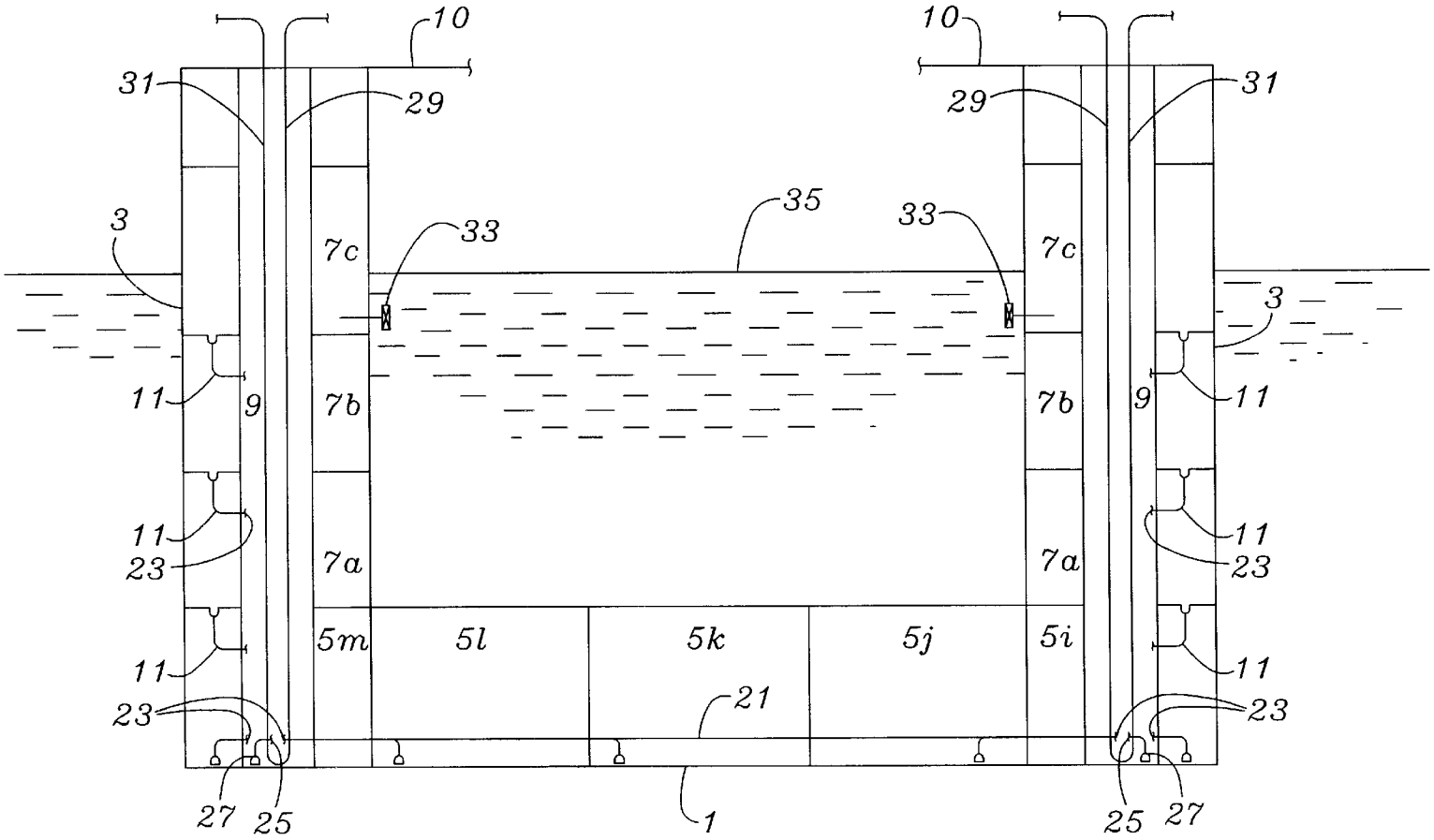
FIG. 2 is a vertical cross-sectional view (taken along section A—A shown in FIG. 1) of the hull structure.
Figure 3:
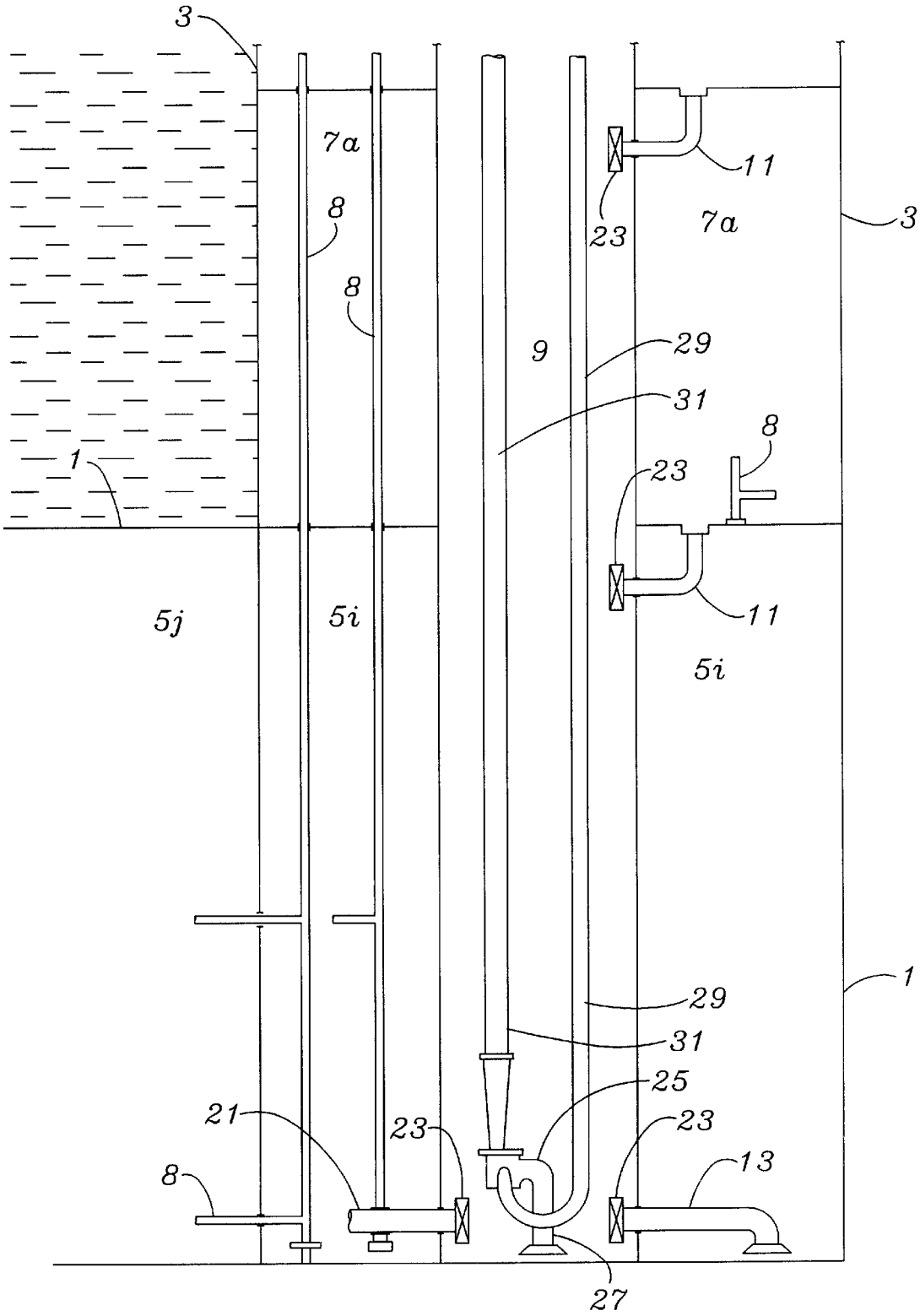
FIG. 3 is a vertical cross-sectional view of one of the drain wells in a vertical column and pontoon of the hull structure depicted in FIGS. 1 and 2.

One simplification provided by the invention is the use of a drain well-eductor system to adjust the ballast, as needed for trimming or other purposes, of the TLP. FIGS. 1–3 show a preferred embodiment of the drain well-eductor system. In FIGS. 1 and 2 the overall hull structure is depicted, with the lower portion being a rectangular pontoon 1 with four vertical columns 3 of equivalent height emanating from each corner of pontoon 1. The columns support a truss structure (not shown) which, in the best mode, supports a production deck 10 at an elevation about equal to the top of the columns and, at a higher elevation, a drill deck (not shown). Both pontoon 1 and the columns 3 are divided into compartments functioning as ballast tanks. The pontoon, as best shown in FIG. 1, is divided into sixteen rectangular compartments 5*a–p*, while each column (two shown in cross-section in FIG. 2) contains three rectangular ballast compartments 7*a*, 7*b*, and 7*c* above the pontoon. All compartments, both in the pontoon 1 and the columns 3, have associated therewith a typical vent and sound system for venting and level determination, portions of which are depicted in FIG. 3, as indicated by reference numeral 8.

Provided in each of the four corner areas of the hull structure is a circular (12 feet diameter) drain well 9 centrally located through each column 3. Each drain well extends from the floor of the inner portion of pontoon 1 up through a column 3 to the production deck 10 (or other work platform). A drain system is provided, using 6 inch lines, by which each ballast compartment can drain into one nearby drain well 9. The upper ballast compartments 7*a*, 7*b*, and 7*c* can drain into drain well 9 via 6 inch elbows 11 (FIG. 2) while each of the pontoon ballast compartments 5*a–p* has an individual horizontal 6 inch drain line 13 leading to a drain well 9 (FIG. 1). Additionally, the drain wells 9 are interconnected, each to its neighbor, by 6 inch drain conduits 15, 17, 19, and 21 (FIG. 1). Each elbow, drain line and drain conduit terminates in a drain well 9 via a 6 inch butterfly valve 23. (See most especially FIG. 3.) These butterfly valves 23 are individually operated by reach rods (not shown) extending from each valve 23 up through the drain well 9 to the production deck 10.

Also provided in each drain well 9 is a ladder (not shown) leading from the production deck 10 to the lowest portion of the well. Situated there is a submersible pump, such as an eductor 25, capable of drawing liquid from the lowest portion of the drain well via suction line 27, i.e., line 27 opens via a flange roughly 3 inches from the bottom of the floor of the drain well. Eductor 25 employs water as the motive fluid introduced into 4 inch line 29 via a pump (not shown) on the production deck 10 (or other location external to the drain well 9). The eductor discharges the motive fluid and liquid drawn from suction line 27 up 6 inch line 31 ultimately to discharge to the ocean.

Most preferably, the pump used on the production deck 10 to provide the motive fluid for eductor 25 is a fire pump (not shown) which is suitably connected not only to lines 29 in drain wells 9 but also to a system of sprinklers, hydrants, and other fire fighting equipment (not shown) located throughout the TLP. This pumping system may also, if desired and practicable, and preferably with appropriate control valves in a "fail safe" normally closed or open position as required to ensure a supply of water for the fire system in a fire emergency, lead to other systems or devices requiring pressurized water. One such system could involve piping leading to propulsion nozzles to provide intermittent thrusting forces to aid in positioning the TLP. However, in the preferred embodiment, the pumping system is devoted solely to serving the fire fighting system and providing water to the drain well-eductor system. In the latter capacity, the fire pump serves not only to provide a motive fluid for eductors 25 but also to aid in ballasting the TLP, as will now be explained.

The main purpose of the drain well-eductor system is to ballast or deballast as needed (for trim operations and the like) after installation of the TLP. When deballasting is required, one or more of drain valves 23 (as appropriate) are opened using the appropriate reach rod(s) to allow water from one or more ballast compartments 5*a–p*, 7*a*, 7*b*, or 7*c* to drain into drain well(s) 9. As a result, water will then begin to fill one or more of the drain wells 9. The operator has a choice as to how many of the drain wells 9 to fill by opening or closing as necessary the butterfly valves 23 terminating at the ends of drain conduits 15, 17, 19, and 21 interconnecting drain wells 9. If desired, all four of the drain wells can simultaneously be filled, even if only one ballast compartment is draining at a time. While the ballast compartment(s) are draining into one or more of drain wells 9, an eductor 25 in at least one of the drain wells filling with water—and preferably all of eductors 25 in drain wells 9 filling with water—are then supplied with water as a motive fluid from the fire pump via line 29. Eductor(s) 25 then draw water via their respective suction line 27 from their respective drain well 9, thereby removing water from drain well(s) 9 by ejecting the water up line 31 to overboard discharge. Thus, while water drains from one or more of the ballast compartments into a drain well(s), the eductor 25 therein is removing water from the drain well and directing it to an overboard location.

Conversely, when it is desired to add water to a ballast compartment, the butterfly drain valve 23 associated therewith is opened to a drain well 9 using the appropriate reach rod. Then, the fire pump is employed, not to pump water down line 29, but to fill the drain well 9 by using fire hoses or suitable piping (not shown) to discharge water into the top of the drain well 9. The drain well then fills from the bottom, and water enters the drain line 13 leading to the appropriate ballast compartment. Once the ballast compartment is filled to the desired level, the drain valve 23 is closed. The water remaining in the drain well 9 can then be removed by use of eductor 25 as described above.

It follows from the immediately preceding discussion that a butterfly drain valve 23 associated with a particular pontoon or column ballast compartment serves not only to drain that compartment but to fill it as well. And by opening the appropriate drain valves 23, a plurality of ballast compartments can be simultaneously filled or drained, as desired.

The drain well-eductor system of the invention provides numerous advantages. Normally, in a TLP, a pump room, located in the pontoon, and complete with equipment such as motor-driven ballast and bilge pumps, manifolds, sea chests, power outlets and cables, lighting, elevators, and life support systems, is employed to provide ballast and deballast of the TLP ballast compartments. The pump room, of necessity, requires substantial manning for operation and maintenance and, further, presents a substantial risk if inadvertently flooded. In contrast, the drain well-eductor system of the invention, by replacing the pump room with a simple eductor having no moving parts and requiring no electrical power, substantially reduces both the operational and maintenance requirements associated with ballasting and deballasting the TLP—and this at a fraction of the capital and operational costs associated with a pump room. In addition, the danger due to accidental flooding is eliminated because the eductor 25 is operable even when flooded. Indeed, as shown in the discussion above, the invention relies upon the capability of eductor 25 to operate when flooded to fill and drain the ballast compartments. In sum, the eductor-drainwell system of the invention provides a low cost, simplified, and essentially maintenance-free alternative to prior art means and methods for ballasting and de-ballasting a TLP.

Rapid Deballast System

The TLP of the invention also provides a simple and inexpensive means and method for rapid deballasting to avoid or greatly minimize any safety risk due to the wave natural period matching the natural period of the TLP during installation. One or more of the uppermost compartments 7*c* in the columns 3 are provided with one or more high capacity flow valve(s) 33, such as a large butterfly valve, e.g. a 16 to 72 inch diameter butterfly dump valve and preferably a 30 inch butterfly valve, for rapid draining into the ocean (or other surrounding water body). In FIG. 2 two such butterfly dump valves 33 are shown, one for each of the uppermost compartments 7*c* of the two columns 3. These valves are individually operable by a reach rod or tie rod (not shown) extending upwardly along the exterior of the hull to the production deck 10 (or other work platform). If desired, the uppermost compartments 7*c* having a butterfly dump valve associated therewith may also be further provided, by suitable piping (not shown) leading to the upper portion of the uppermost compartment 7*c*, with air supplied at a superatmospheric pressure of about 15 psig or less, usually on the order of 1–10 psig, and typically about 5 psig. The air, of course, is to aid in draining compartment 7*c* through dump valve 33 as rapidly as practicable.

As shown in FIG. 2, the TLP is in a heavily loaded "ballast" condition for installation, floating such that the ocean surface 35 is about midway up the uppermost compartments 7*c*. As such, the butterfly dump valves 33 are below the surface of the ocean. After being properly positioned, tendons anchored in pilings on the ocean floor are attached to the TLP. Once attached, the TLP is then tensioned by rapidly deballasting water from compartments 7*c* to the ocean through butterfly dump valves 33, using air pressure for assist if available, the TLP thus being lifted and then "tensioned" into its operating position for drilling and/or production activities.

In the best mode, one dump valve 33 is provided with each compartment 7*c* of each column 3 so that, with all the dump valves 33 open, the TLP is deballasted with a minimum of pitching or rolling, i.e., the TLP is lifted as vertically as possible during the rapid deballasting. Once the time required for deballasting is chosen, the number of butterfly dump valves 33 to be used, and their individual sizes, must be designed to provide a flow rate sufficient to rapidly deballast in the time desired. Preferably, the time required for the TLP to be heaved into its operating position by rapid deballasting is no more than ½ hour from the time at least one of the dump valve(s) 33 is opened. More preferably the time for rapid deballasting is no more than 20 minutes, more preferably still no more than 15 minutes, and even more preferably less than 10 minutes, and most preferably no more than about 5 minutes.

After the TLP is installed, the butterfly dump valve(s) 33 usually serve no further purpose, so long as the TLP remains in its "tensioned" position. Any future ballast-deballast procedures needed for trimming can be handled by eductor (s) 25 draining or filling compartments 5*a–p* and 7*a, b*, and *c*, as appropriate. It is, however, preferred for safety reasons, once the TLP is in the "tensioned" position, that the butterfly valve(s) 33 be closed, and a blind flange installed on the exit port(s) thereof. This procedure ensures that the TLP is not dependent upon the integrity of the valve in preventing water from accidentally entering the hull and causing flooding while the TLP remains positioned in one location. Should it be required that the TLP be moved to a different position, the blind flange will usually be left in place until just prior to being re-positioned in a new location. Then, the blind flange can be removed, and the TLP tensioned into position, again using the butterfly dump valve(s) 33 as described above.

It will be seen that the rapid deballast system of the invention, as just described, offers major advantages over the conventional method using large capacity pump(s). Essentially, such a pump is only used for its maximum capacity for each positioning of the TLP; and so long as the TLP remains in position, the large capacity pump is oversized for the needs of the TLP. Thus, such a pump adds unneeded weight to the TLP and imposes a maintenance and cost burden out of proportion to its usefulness. In contrast, the rapid deballasting system of the invention requires only a simple, efficient, low cost butterfly valve(s), which, after use, can be blind flanged, thus avoiding any further attention until the TLP is moved to another position.

Although the invention has been described above in relation to the best mode and some alternative embodiments, it will be apparent to those skilled in the art that many changes or modifications may be made without departing from the invention. For example, the dump valves 33 are shown as initially below water level in FIG. 2; obviously, another design may provide for the dump valves to initially be above the water line, or some above the water line and others below. Another example: where the ballast system as shown in FIGS. 1 and 2 provides for each ballast compartment to have one drain line, another design allowing for two or more drain lines leading to the same or different drain wells 9 could also be used. Likewise, where FIGS. 1 and 2 of the drawing show a drainwell in each of the four columns, a modification providing for fewer drainwells than the total number of columns is within the inventive concept. Additionally, it is possible to enhance the rapid de-ballasting embodiment of the invention by draining ballast compartments 7*c* not only through the dump valves but also through one or more of the drainwells 9, using the eductors 25 therein to pump water overboard through line 31. Additionally, while 6 inch drain lines or conduits are contemplated in the preferred embodiment of the drain well-eductor system as described hereinbefore, these sizes are not critical. Larger sizes—e.g., 8 inch or 12 inch—or smaller—e.g., 4 inch—may also be used. Accordingly, it is intended to embrace within the invention all such changes, modifications, and alternative embodiments as fall within the spirit and scope of the appended claims.

We claim:

1. A hull for an offshore tension leg platform comprising a pontoon and vertical columns connected to said pontoon, said hull having a ballast system comprising:

(A) a ballast compartment in said hull;

(B) a drain well within a vertical column;

(C) a drain line providing liquid-flow communication between said drain well and said ballast compartment;

(D) a valve in said drain line; and (E) a pump in the lower portion of said drain well for pumping liquid out of said drain well.

2. The hull of claim 1 wherein said ballast system comprises a plurality of ballast compartments in said pontoon and at least one ballast compartment in each of said vertical columns.

3. The hull of claim 2 wherein said valve is operable from a location outside said drainwell and said pump is capable of removing water from the lowest portion of said drain well.

4. The hull of claim 3 wherein said vertical columns each comprise a plurality of ballast compartments.

5. The hull of claim 4 wherein said valve is located in said drain well and is operable by a reach rod extending up the drain well.

6. The hull of claim 5 wherein said drain well extends from the vertical column into the pontoon, and said pump is located in the lowest level of the drain well.

7. The hull of claim 1, 3, or 6 wherein said pump is an eductor in liquid-flow communication with a second pump external to the drain well to provide motive liquid for the eductor, with the eductor further in liquid-flow communication with an exit conduit for carrying the motive fluid and liquid in the drain well to a location external to said drainwell.

8. The hull of claim 7 wherein said second pump is a fire pump in liquid-flow communication with one or more means for providing water in a fire emergency.

9. A ballast system for a hull of an offshore tension leg platform, said hull comprising vertical columns connected to an essentially horizontal pontoon, said ballast system comprising:

(A) one or more drain wells, each within a different vertical column and penetrating into the pontoon;

(B) a plurality of ballast compartments in said hull, each of which ballast compartments is in liquid-flow communication with a drain well only by one or more drain lines each terminating in a valve fluidly communicating to said drain well, said valve being operable from a location external to the drain well; and (C) an eductor in each of said drain wells for removing liquid from the drain well via an exit conduit in response to a motive fluid provided by a pump in fluid communication with said eductor but located external to the drain wells.

10. The ballast system of claim 9 having at least two drain wells each in different columns.

11. The ballast system of claim 9 having at least three drain wells each in different columns.

12. The ballast system of claim 9 having at least four drain wells each in different columns.

13. The ballast system of claim 9 or 12 wherein each of said valves is located within a drain well and is operable by a reach rod extending up the drain well, and wherein each ballast tank is in liquid communication to another ballast tank only through a drain well.

14. The ballast system of claim 13 wherein the pontoon and a plurality of the columns of the hull each contains a plurality of ballast compartments.

15. The ballast system of claim 12 wherein each drain well is in gravity liquid-flow communication with at least one other drain well.

16. The ballast system of claim 15 wherein all of said drain wells are in gravity liquid-flow communication with all other drain wells.

17. The ballast system of claim 10 wherein each drain well is connected by a drain conduit to another drain well such that liquid can flow by gravity between said drain wells through said drain conduit at a relatively low elevation in the hull.

18. The ballast system of claim 12 wherein each drain well is connected by a drain conduit to another drain well such that liquid can flow by gravity at a relatively low elevation in the hull from one of said drain wells into all the other drain wells.

19. The ballast system of claim 17 or 18 wherein a valve terminates each end of said drain conduits connecting said drain wells, said valves being operable from a location external to the drain wells.

20. The ballast system of claim 14 wherein each drain well is connected in the pontoon by a drain conduit to another drain well such that liquid can flow by gravity from one of said drain wells into all the other drain wells.

21. The ballast system of claim 20 wherein a valve terminates each end of said drain conduits connecting said drain wells, with said valves being located within a drain well and being operable from a location external to the drain wells by reach rods extending up the drain wells.

22. The ballast system of claim 21 wherein the hull has a pontoon of rectangular-shaped cross-section, with a column at least at each of the four corners, and drain wells in each of the corner columns, with each corner column having a plurality of ballast compartments, and the pontoon having a plurality of ballast compartments between adjacent corner columns, and each valve in a drain line and drain conduit operable by said reach rods being a butterfly valve.

23. The ballast system of claim 22 wherein the pontoon in cross-section is substantially in the shape of a square, the hull is substantially in the shape of a block, and the drain wells are each substantially in the shape of a cylinder.

24. The ballast system of claim 23 wherein each eductor in each drain well is located in substantially the lowest elevation thereof.

25. The ballast system of claim 24 wherein the lowest elevation of each of the drain wells is essentially the floor of the pontoon, and the eductor draws liquid from the drain well at a level less than 6 inches above the floor.

26. The ballast system of claim 25 wherein said pump is a fire pump in liquid-flow communication with one or more means for discharging water in a fire emergency.

27. The ballast system of claim 9 wherein said hull has a ballast compartment in the upper portion of at least one of the columns, with said compartment fluidly communicating through the exterior of said hull by a valve providing, in the fully open position, an opening at least about 12 inches in diameter.

28. The ballast system of claim 9 wherein said hull has a ballast compartment in the upper portion of a plurality of said columns, with a plurality of said compartments individually fluidly communicating through the exterior of said hull by a butterfly valve providing, in the open position, an opening at least about 18 inches in diameter.

29. The ballast system of claim 9 wherein said hull has a ballast compartment in the upper portion of each of said columns, with each of said compartments individually fluidly communicating through the exterior of said hull by a butterfly valve providing, in the open position, an opening at least about 36 inches in diameter.

30. A method for installing a tension leg platform in a body of water comprising:

(1) attaching tendons anchored to the underwater floor of said body of water to a platform structure comprising a platform supported on a hull comprising a pontoon and vertical columns, with one or more of said vertical columns containing sufficient water in ballast compartments in the upper locations thereof such that said platform structure floats in said body of water with a natural period greater than that of the wave natural period associated with the surrounding water; and (2) rapidly deballasting water from said hull such that said platform structure rises within an hour to a tensioned positioned floating in said body of water with a period less than that of the wave natural period, said rapid deballasting being accomplished in substantial part by draining water from one or more of said ballast compartments in said upper locations of said columns through one or more valves to the exterior of the hull without the use of a pump.

31. A method as defined in claim 30 wherein said draining is accomplished by gravity draining.

32. A method as defined in claim 30 wherein said draining is accomplished by gravity draining assisted by air pressure.

33. A method as defined in claim 31 or 32 wherein said rapid deballasting occurs within one-half hour and at least half the water deballasted during said rapid de-ballasting is through one or more of said valves.

34. A method as defined in claim 31 or 32 wherein said rapid deballasting occurs within 20 minutes and substantially all the water deballasted during said rapid deballasting is through one or more of said valves.

35. A method as defined in claim 31 wherein said one or more valves are butterfly valves, which, in the open position, provide an opening at least 16 inches in diameter.

36. A method as defined in claim 31 wherein said one or more valves are butterfly valves, which, in the open position, provide an opening at least 24 inches in diameter.

37. A method as defined in claim 31 wherein said one or more valves are butterfly valves, which, in the open position, provide an opening at least 30 inches in diameter.

38. A method as defined in claim 31 wherein said one or more valves are butterfly valves which, in the open position, provide an opening at least 48 inches in diameter.

39. A method as defined in claim 31 wherein said rapid deballasting removes water from one or more ballast compartments in upper locations of a plurality of said columns.

40. A method as defined in claim 31 wherein said rapid deballasting removes water from a plurality of ballast compartments, each in an upper location of a different column.

41. A method as defined in claim 31 wherein said rapid deballasting removes water from a single ballast compartment in an upper location of each column.

42. A method as defined in claim 31 wherein at least 75% of the water deballasted during said rapid deballasting is through one or more of said valves.

43. A method as defined in claim 31 wherein said rapid deballasting occurs within 15 minutes and all the water deballasted during said rapid deballasting is through one or more of said valves.

44. A method as defined in claim 31 wherein no pump is used during the rapid deballasting.

* * * * *